United States Patent [19]

Pottorff

[11] Patent Number: 4,723,466

[45] **Date of Patent: * Feb. 9, 1988**

[54] SELF-SHARPENING HOLE PUNCH FOR PACKAGING WITH RESILIENT WASTE EXPELLING MECHANISM

[76] Inventor: Earl T. Pottorff, 2346 Taylor Rd., Savannah, N.Y. 13146

[ * ] Notice: The portion of the term of this patent subsequent to Mar. 31, 2004 has been disclaimed.

[21] Appl. No.: 827,905

[22] Filed: Feb. 10, 1986

Related U.S. Application Data

[63] Continuation-in-part of Ser. No. 748,920, Jun. 26, 1985, Pat. No. 4,653,372.

[51] Int. Cl.[4] ..... B26F 1/14; B26D 7/06

[52] U.S. Cl. ..... 83/128; 83/139; 83/542; 83/684; 83/689

[58] Field of Search ..... 83/123, 128, 139, 100, 83/636, 689, 542, 684

[56] References Cited

U.S. PATENT DOCUMENTS

| | | | |
|---|---|---|---|
| 2,214,743 | 9/1940 | Lamb | 83/128 |
| 3,137,188 | 6/1964 | Domka | 83/128 |
| 3,939,743 | 2/1976 | Coombes | 83/123 |
| 4,653,372 | 3/1987 | Pottorff | 83/689 |

OTHER PUBLICATIONS

Jackson et al., Acetal Homopolymer, Modern Plastics Encyclopedia, pp. 8–9, 1985.

*Primary Examiner*—Paul A. Bell
*Assistant Examiner*—Scott A. Smith
*Attorney, Agent, or Firm*—Bruns and Wall

[57] ABSTRACT

A self-sharpening hole punch for plastic bags includes a pneumatically operated punching apparatus for punching wicket pin receiving holes in a flexible film or plastic bag. If desired, a tear slit may be simultaneously formed to enable the bag to be quickly and readily torn free from the wicket pin upon which the bag is retained. A pneumatic air cylinder has a cylinder rod with a fitting affixed thereto, the fitting having an internal tapered thread. Interchangeable plastic cutting tools, having a complementary tapered thread, may be interchangeably screwed into the fitting to facilitate replacement as necessary. A resiliently compressible cylinder of foam plastic material is disposed in a circular void at the cutting side of each of the plastic cutting tools to expel the waste film discs that are punched out of the film or plastic bag material.

4 Claims, 4 Drawing Figures

SELF-SHARPENING HOLE PUNCH FOR PACKAGING WITH RESILIENT WASTE EXPELLING MECHANISM

This is a continuation-in-part of my co-pending application Ser. No. 748,920, filed June 26, 1985 now U.S. Pat. No. 4,653,372.

BACKGROUND OF THE INVENTION

This invention relates, in general, to hole punching apparatus and, in particular, to apparatus for perforating packaging material.

More specifically, but without limitation to the particular apparatus described herein for purposes of setting forth an illustrative preferred embodiment, and the best mode presently contemplated for carrying out the invention, this invention relates to an apparatus for punching holes in flexible synthetic resin film or in plastic bags.

As is known to those skilled in the art, flexible plastic film or plastic bags formed from materials such as polyethylene, are frequently used to package loaves of bread or other food or non-food articles. In such operations, a quantity of these bags is retained on a substantially U-shaped wicket pin with the bags being carried thereon by positioning the free ends of the wicket pin through a pair of holes formed in the upper portion of the bag. The bags may then be individually removed from the wicket pin and an article, such as a load of bread, is placed in the bag.

In order to hold the bags on the wicket pin in a proper position so that the bags may be loaded, there are formed in the bag a pair of holes through which the free ends of the wicket pin pass. In certain applications it is also advantageous to be able to quickly pull or tear the bag from the wicket pins, rather than withdrawing the bag from the wicket pins upon which the bags have been placed. To this end, provision must be made so that when the bag is pulled to be torn free from the wicket pins, the bag material will tear in a predictable manner. In this way the bag can be readily removed while maintaining the integrity of the receptacle portion thereof into which an item is placed.

Various mechanisms have been provided to punch such holes in plastic materials. Two such devices are disclosed in U.S. Pat. No. 3,550,494 "MULTIPUNCH SYSTEM FOR FLEXIBLE FILM PRODUCTS" AND U.S. Pat. No. 3,973,453 "RADIAL ALIGNED PUNCH". Each of these patents discloses apparatus for perforating flexible film products such as a plastic bag, so that the bag can be supported for releasable retention on a wicket pin by passing the arms of the wicket pin through openings formed in the plastic material. U.S. Pat. No. 3,973,453 also discloses a punch member having a single cutting line face for forming a line slit in projected continuation with the line slit forming the wicket pin receiving opening to facilitate easy removal of the bag structure from the wicket pin.

U.S. Pat. Nos. 3,654,829; 4,160,396 and 4,308,774 each disclose additional apparatus for perforating thermoplastic material utilizing a serrated knife edge to cut or punch a hole in a plastic film. Heretofore such cutters have been formed from metal and require frequent periodic sharpening so that they will be keen enough to cut through the plastic. During the cutting operation, the plastic material is supported upon a backing plate having a hole formed therein which is of a diameter larger than the cutting tool. The backing plate so formed enables the cutting tool to move through the plastic material while the material is held in position against the plate.

The metal cutting tools as used in the prior art are satisfactory so long as the cutting tool remains sharp, and the tool and hole in the backing plate are maintained substantially concentrically out of contact during the high speed punching operation. The hole in the backing plate must be approximately the same size as the punching die or cutting tool to prevent stretching of the plastic material. If proper alignment is not maintained, the teeth of the cutter will be broken requiring replacement of the entire cutting head. In addition, the cutting of the thermoplastic material rapidly wears the metal cutting surfaces thus dulling the cutting tools and requiring regrinding or resharpening of the cutting edge. The wear soon becomes excessive and the tool must be replaced.

Care must be taken to ensure that the cutting heads do not jam from the discs of waste material resulting from the punch operation. If the waste discs are allowed to accumulate within the cutting heads, the apparatus may jam, and the holes may not be cut efficiently.

SUMMARY OF THE INVENTION

Accordingly, it is an object of this invention to provide apparatus for punching holes in thermoplastic material, which apparatus avoids the drawbacks of the prior art.

It is a further object of this invention to maintain the sharpness of a cutting edge utilized to punch holes in thermoplastic material.

Yet another object of this invention is to accommodate the use of various size cutting tools which may be interchangeably mounted on a base member.

Still another object of this invention is to reduce the weight of the cutting apparatus to minimize the inertial forces created during the high speed punching operation, thereby reducing wear and eliminating the necessity of complex mechanical systems.

A more specific option is to minimize or eliminate the problem of accumulation of waste discs of the cut material resulting from the punching of wicket-receiving holes.

These and other objects are attained in accordance with the present invention wherein there is provided a mechanically operated punching apparatus for punching wicket pin receiving holes in a flexible film or plastic bag. If desired, a tear slit may be simultaneously formed to enable the bag to be quickly and readily torn free from the wicket pin upon which the bag is retained. The disclosed embodiment utilizes a pneumatic air cylinder wherein the free end of the cylinder rod has a fitting secured thereto containing an internal tapered thread. Interchangeable plastic cutting tools, having a complementary tapered thread, may be interchangeably threaded into the fitting to facilitate replacement as necessary.

Favorably, these plastic cutting tools are cylindrical cutting heads, each having a generally cylindrical cutting edge defining within it a cylindrical void. A cylindrical ejection member is disposed in this void and acts to eject the discs of waste material that would otherwise accumulate and remain within the cutting head. In a preferred embodiment, this member is a cylinder of a compressible resilient foam material which in a free state has its distal end face extending beyond the forwardmost portions of the cutting edge, and which in a compressed state has that end face behind the rearward portions of the cutting edge.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout wherein.

DESCRIPTION OF THE PREFERRED EMBODIMENT

Figure 1:
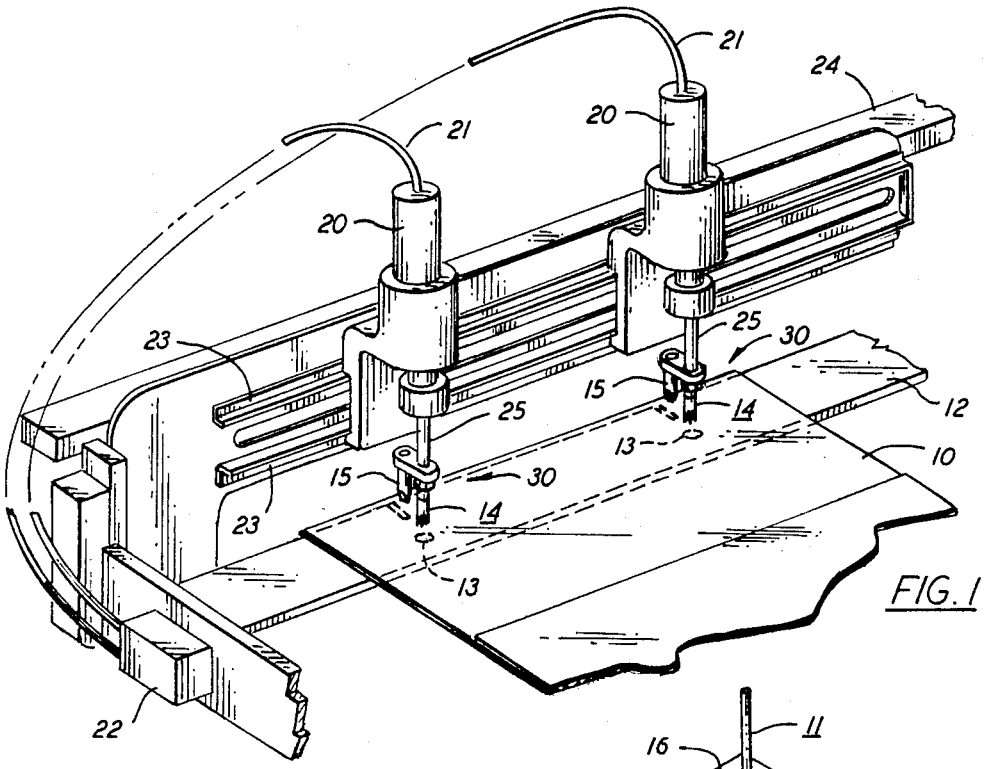
FIG. 1 is a front perspective view of an apparatus embodying the invention for cutting holes in plastic bags.
Figure 2:
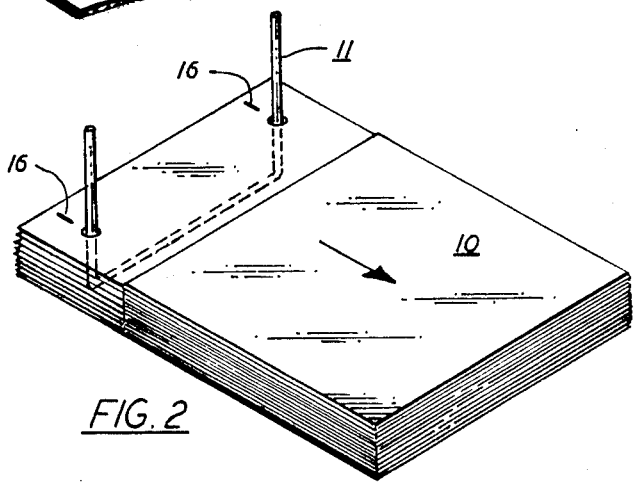
FIG. 2 is a frontal perspective view of a quantity of plastic bags having holes punched therein and positioned on a wicket pin for further processing.

Referring now to FIG. 1, there is illustrated an apparatus for punching holes in flexible plastic film or plastic bags 10 so that these bags may be placed on a substantially U-shaped wicket pin 11 as shown in FIG. 2. In operation, the plastic bag 10 is positioned on a backing plate 12 by means of, for example, a sheet feeding device, not shown. The backing plate 12 has a plurality of apertures 13 formed therein which are of a size slightly larger than a cutting head 14 by which holes in the bag 10 are formed. Slit cutters 15 permit the cutters to form predetermined slits 16 in the plastic bag preventing the plastic material from stretching or being sufficiently resistive to being torn from the wicket pin 11 that the receptacle portion of the bag is rendered useless.

While the apparatus in FIG. 1 discloses a pair of adjustable pneumatically operated cylinders 20 as being used for the punching mechanisms, it is to be understood that the cutting tool to be hereinafter described in detail may be utilized with various reciprocating devices. A plurality of units may be mounted to a single operable punching cylinder or a greater number of cylinders may be utilized depending upon the particular punch apparatus and the number of holes to be formed on bags to be simultaneously processed.

The punching mechanism illustrated in FIG. 1 comprises an air operated cylinder 20 connected by suitable conduits 21 to a controller 22 whereby the air cylinders may be sequentially operated in synchronism with the feeding of the plastic bags 10 onto the backing plate 12. A pair of guides 23 are positioned on a cantilevered support arm 24 to permit the cylinders 20 to be positioned transversely of the bag to accommodate various positioning for the holes to be formed therein. Similarly, the backing plate 12 can be formed with a series of apertures 13 positioned in predetermined spacial relationship to accommodate lateral spacing of various standard wicket pins 11. Depending upon the particular application wherein the plastic bag is utilized, the slitter 15 may be carried on the cylinder rod 25 of the punching apparatus to provide the slit 16 between the hole formed by the cutting head or punch 14 and an adjacent edge of the plastic bag. As discussed previously, such a slit 16 will provide a frangible portion such that when the bag 10 is pulled from the wicket pin 11 in the direction indicated in FIG. 2, the bag will be torn free from the wicket pin 11 in a predetermined manner. Slitting may be required or desirable in an application wherein the bags 10 are to be contained on the wicket pin 11 and an article such as a loaf of bread, not shown, is inserted into the bag which is thereafter torn free from the wicket pin to be conveyed for further processing.

Figure 3:
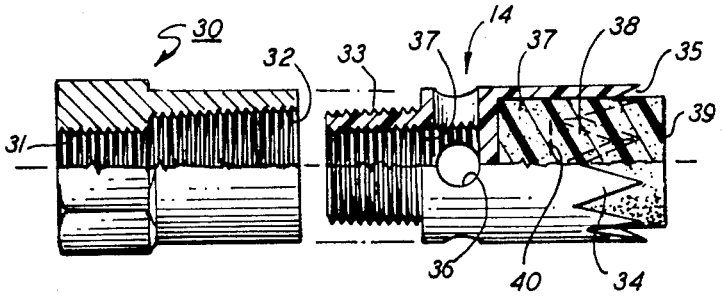
FIG. 3 is an enlarged planar view of the cutting tool utilized in the apparatus shown in FIG. 1 with portions thereof broken away to better illustrate the construction thereof.

As best shown in FIG. 3, the cutting tool of the hole punching apparatus includes a base coupling 30 formed of metallic material and having an internal thread portion 31 by which the base coupling 30 is secured to the free end of the retractable cylinder rod 25 of the pneumatic cylinder 20. This metallic coupling is formed at its opposite end with an internal tapered thread 32 for receiving a complementary tapered external thread 33 of the cutting head 14. The cutting head is formed of a plastic material such as Delrin, a trademark of Dupont Company for a base plastic material, namely an acetal homopolymer. While other plastic materials may be suitable, it has been found that TEFLON, a trademark for DuPont Corporation for tetrafluoroethylene is too soft for this use. Ceramic material has been found to be too brittle and, therefore, Delron or a thermoform type of resin with its qualities has been found to be the preferable material for forming the cutting head 14. This material has been found to be resilient enough so that if the cutting head 14 contracts the backing plate 12 during the punching operation, the plastic material has sufficient flexibility to permit the cutting operation to continue, rather than breaking the cutting teeth 34 formed on the cutting head.

In prior art devices which utilize cutters formed of metal, when the cutting head contacted the side walls or the backing plate itself, the cutting teeth would break. This breakage required shut down and disassembly of the machine, and replacement or regrinding of the entire cutting head, depending upon the severity of the break. With the interchangeable cutting head 14 of plastic Delrin material, not only is the breakage problem eliminated, but the size of the holes to be punched in the plastic material can be readily varied. The machine operator has only to unscrew the tapered thread 33 of the plastic cutting head 14 from the metallic base portion 30 and insert a new cutter head to change the hole size. The use of tapered threads insures a tight connection. In addition, when the plastic cutting head 14 finally becomes worn and must be replaced, the cutting head can be merely unscrewed from the base portion and another plastic cutting head inserted. This ease of replacement permits inexpensive and rapid replacement of the operating cutting portion 14 of the punching apparatus, and avoids substantial periods of down time.

Another benefit that has been attained with these Delron type plastic cutting heads 14 is that the cutting head lasts far longer than a conventional metallic cutting head of the prior art. For example, it has been found that the tapered knife edge portions 35 formed on the pointed cutting teeth 34 circumferentially spaced about the free end of the cutting head 14, actually form a self-sharpening cutting edge when punching holes in the plastic material. These replaceable cutting heads 14 are found to last four times as long as metal cutting heads utilized in the prior art, and accordingly are much less expensive from the standpoint both of initial cost and of replacement cost. It is believed that this self-sharpening occurs because of plastic-on-plastic abrasion.

In addition, the lighter weight of the plastic cutting head 14 results in less wear on the mechanical components of the punching apparatus, which also helps reduce loosening of the tapered threaded portion 33 of the cutting head 14 from within the internal threaded portion 32 of the connector fitting 30. A plurality of vent holes 36, spaced circumferentially about the plastic cutting head 14 in communication wit an internal base 37 formed coaxially in the cutting head 14, accommodate insertion of a lever arm to facilitate tightening or loosening of the cutting head 14 onto or from the connector base 30 and in addition prevent air pressure from interferring with high speed punching operations.

As is further shown in FIG. 3, a void 37 formed within the circle of cutting teeth 34 holds a cylinder 38 of a resilient compressible foam plastic material, the cylinder 38 serving as a blackout or ejection mechanism. In this embodiment, the cylinder 38 is open-celled polyurethane foam. In a free or uncompressed mode, the free length of the cylinder 38 is such that its distal end surface 39 extends outward beyond the tips of the cutting teeth 34, but in a compressed mode, this end surface 39 is disposed, as shown by the broken line 40, within, or proximally of, the base of the teeth 34.

Figure 4:
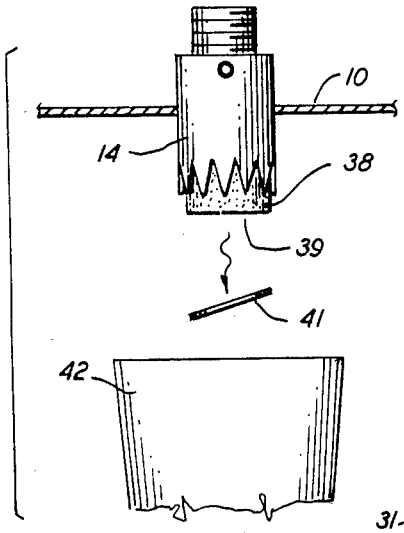
FIG. 4 is a partial elevation for explaining the operation of the apparatus of this invention.

In operation, when the cutting head 14 cuts through the plastic bag 10, the cylinder 38 compresses as the cutting head cuts out a disc 41 of the plastic film bag material. When the head 14 is through the bag 10, the end surface 39 of the cylinder 38 pops back out to its extended position, as shown in FIG. 4, and the disc 41 is a waste receptacle or collecting bin 42. This arrangement works well at high industrial speeds, and prevents build up of the waste discs 41.

The ejector mechanism is not limited to polyurethane foam, as many equivalents exist and would be employed as deemed most favorable for a particular end use or application.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best way presently known for carrying out the invention but that the invention will include any embodiment falling within the scope of the appended claims.

I claim:

1. An apparatus for punching holes in a web of film packaging material wherein said material is registered in alignment with a reciprocal punching device, the device being actuated for reciprocating movement in a direction generally normal to the plane of the film packaging material for passing one or more cutting heads through an apertured backing plate upon which the film packaging material is supported, thus punching one or more holes in said material, the improvement wherein each of said cutting heads comprises a generally cylindrical head formed of a flexible semi-rigid thermoformable resin material and having a generally cylindrical peripheral cutting edge formed of tapered, serrated cutting teeth that are bevelled to form the cutting edge defining a circular void therewithin, and a cylindrical ejection member disposed in said void and formed of a compressible resilient material for ejecting waste discs of said film packaging material from said heads after said apparatus has punched said one or more holes in said film packaging materials; said resin material being sufficiently resilient that if the cutting head contacts the backing plate during a punching operation, the cutting teeth will resiliently deflect rather than break off, so that the cutting operation can continue, and the cutting head being selfsharpening when employed to cut holes in the plastic film material.

2. The apparatus of claim 1 wherein said cylindrical ejection member has a distal end face and a free length in which the end face extends distally beyond said cutting edge and a compressed length in which the end face is disposed proximally within said cutting edge.

3. The apparatus of claim 1 wherein said cylindrical ejection member has a distal end face and a free length in which the end face is disposed distally beyond forward points of said teeth and a compressed length wherein said end face is disposed proximally within rearward points of said teeth.

4. The apparatus of claim 1 wherein said cylindrical ejection member is formed of a resilient foam plastic synthetic resin.

* * * * *